US009997870B2

(12) United States Patent
Fang et al.

(10) Patent No.: US 9,997,870 B2
(45) Date of Patent: Jun. 12, 2018

(54) ELECTRICAL CONNECTOR

(71) Applicant: Drapho Electronics Technology Co, Ltd, Kunshan, Jiangsu Province (CN)

(72) Inventors: Zhihong Fang, Kunshan (CN); Zhijian Mo, Kunshan (CN); Zhuping Wu, Kunshan (CN); Lina Shan, Kunshan (CN)

(73) Assignee: DRAPHO ELECTRONICS TECHNOLOGY CO, LTD, Kunshan, Jiangsu Province (CN)

( * ) Notice: Subject to any disclaimer, the term of this patent is extended or adjusted under 35 U.S.C. 154(b) by 0 days. days.

(21) Appl. No.: 15/393,784

(22) Filed: Dec. 29, 2016

(65) Prior Publication Data

US 2017/0294746 A1 Oct. 12, 2017

(30) Foreign Application Priority Data

Apr. 8, 2016 (CN) ..... 2016 1 02147298

(51) Int. Cl.

| | |
|---|---|
| ***H01R 9/03*** | (2006.01) |
| ***H01R 13/6597*** | (2011.01) |
| ***H01R 24/60*** | (2011.01) |
| *H01R 107/00* | (2006.01) |

(52) U.S. Cl.

CPC ..... *H01R 13/6597* (2013.01); *H01R 24/60* (2013.01); *H01R 2107/00* (2013.01)

(58) Field of Classification Search

CPC . H01R 13/6597; H01R 24/60; H01R 2107/00
USPC ..... 439/660, 607.09–607.11
See application file for complete search history.

(56) References Cited

U.S. PATENT DOCUMENTS

| | | | | |
|---|---|---|---|---|
| 9,312,641 | B2 * | 4/2016 | Wang | H01R 13/6585 |
| 9,490,549 | B2 * | 11/2016 | Little | H01R 4/023 |
| 9,680,254 | B1 * | 6/2017 | Nishikata | H01R 13/627 |
| 9,755,368 | B2 * | 9/2017 | Cheng | H01R 13/6471 |
| 9,768,567 | B2 * | 9/2017 | Cheng | H01R 24/60 |
| 2015/0295362 | A1 * | 10/2015 | Tziviskos | H01R 13/6581 439/607.01 |

* cited by examiner

*Primary Examiner* — Khiem Nguyen
(74) *Attorney, Agent, or Firm* — Locke Lord LLP; Tim Tingkang Xia, Esq.

(57) ABSTRACT

The present invention relates to an electrical connector, which has an insulation body, a shielding plate, a plurality of grounding terminals and conducting terminals accommodated in the insulation body. Each grounding terminal is formed by bending a linear wire and has an upper contacting portion, a bending portion extending from the upper contacting portion, and a lower contacting portion extending from the bending portion, wherein the upper contacting portion is parallel to the lower contacting portion. Therefore, the crosstalk between the upper-row signal terminals and the lower-row signal terminals is reduced, and the shielding effect is enhanced.

18 Claims, 4 Drawing Sheets

ELECTRICAL CONNECTOR

RELATED APPLICATIONS

The present application claims priority under 35 U.S.C. § 119 to People's republic of China Patent Application 2016102147298, which was filed on Apr. 8, 2016, the entire contents of which are incorporated herein by reference.

FIELD OF THE INVENTION

The present invention relates to an electrical connector, in particular to an electrical connector having improved grounding terminals.

BACKGROUND

An existing Type C connector comprises an insulation boy, a plurality of upper-row terminals and a plurality of lower-row terminals assembled to the insulation body, a shielding plate located between the lower-row terminals and the upper-row terminals, and a shell surrounding the periphery of the insulation body. The upper-row terminals include upper-row grounding terminals, upper-row signal terminals and upper-row power terminals. The lower-row terminals include lower-row grounding terminals, lower-row signal terminals and lower-row power terminals. The shielding plate is located between the upper-row terminals and the lower-row terminals to prevent the electromagnetic interference between the upper-row terminals and the lower-row terminals and enhance a high-frequency transmission of the connector. However, the existing Type C connector still has a serious crosstalk problem in a process of transmitting data, thereby affecting the transmission speed of data. When the existing Type C connector is manufactured, an upper body is insert-molded onto the upper-row terminals, a lower body is insert-molded onto the lower-row terminals, and then the upper-row terminals and the lower-row terminals are fixed with the shielding plate. The assembly process is complicated, and the cost is increased.

On account of this, it is certainly necessary to provide an improved electrical connector, to overcome the defects existing in the prior art.

SUMMARY OF THE INVENTION

Accordingly, an object of the present invention is to provide an electrical connector having improved grounding terminals for improving a crosstalk problem thereof.

In order to solve the above technical problem, the present invention provides the following technical solution: an electrical connector comprises an insulation body, a shielding plate, a plurality of grounding terminals and conducting terminals accommodated in the insulation body. Each grounding terminal is formed by bending a linear wire and comprises an upper contacting portion, a bending portion extending from the upper contacting portion, and a lower contacting portion extending from the bending portion, wherein the upper contacting portion is parallel to the lower contacting portion, and the shielding plate is located between the upper contacting portion and the lower contacting portion of the grounding terminal and is in contact with the bending portion.

Compared with related technologies, each grounding terminal of the electrical connector of the present invention is formed by bending a linear wire and comprises an upper contacting portion, a bending portion extending from the upper contacting portion, and a lower contacting portion extending from the bending portion, wherein the upper contacting portion is parallel to the lower contacting portion, and the shielding plate is located between the upper contacting portion and the lower contacting portion of the grounding terminal and is in contact with the bending portion. Therefore, the crosstalk between the upper-row signal terminals and the lower-row signal terminals is reduced, and the shielding effect is enhanced.

DETAILED DESCRIPTION OF THE PREFERRED EMBODIMENTS

Figure 1:
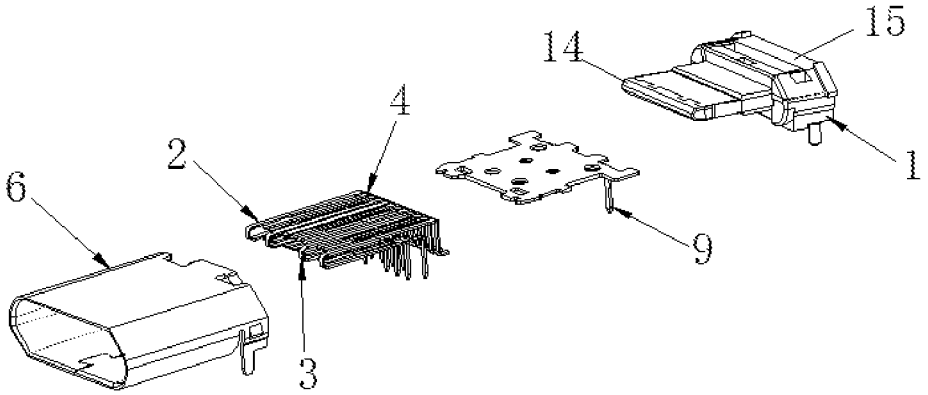
FIG. 1 is an exploded view of an electrical connector of the present invention.
Figure 2:
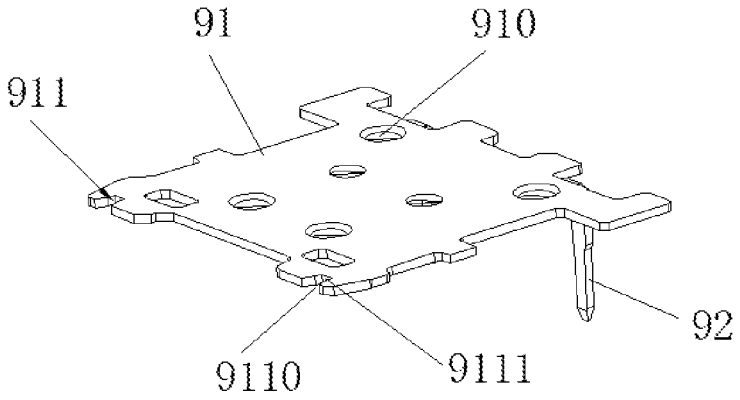
FIG. 2 is a stereogram of a shielding plate of the electrical connector of the present invention.

The following description is presented to enable a person of ordinary skill in the art to make and use the various embodiments. Descriptions of specific devices, techniques, and applications are provided only as examples. Various modifications to the examples described herein will be readily apparent to those of ordinary skill in the art, and the general principles defined herein may be applied to other examples and applications without departing from the spirit and scope of the various embodiments. Thus, the various embodiments are not intended to be limited to the examples described herein and shown, but are to be accorded the scope consistent with the claims.

Referring to FIG. 1 to FIG. 7, an electrical connector of the present invention comprises an insulation body 1, a shielding plate 9, a plurality of grounding terminals 2 and conducting terminals accommodated inside the insulation body 1, and a shell 6 surrounding the periphery of the insulation body 1. The conducting terminals include power terminals 3, upper-row signal terminals 4 and lower-row signal terminals 5.

Figure 3:
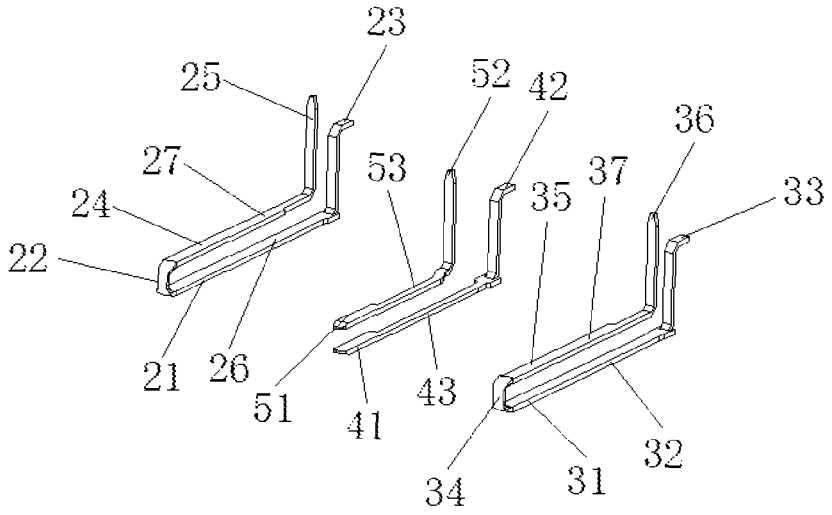
FIG. 3 is a stereogram of grounding terminals, power terminals and signal terminals of the electrical connector of the present invention.
Figure 4:
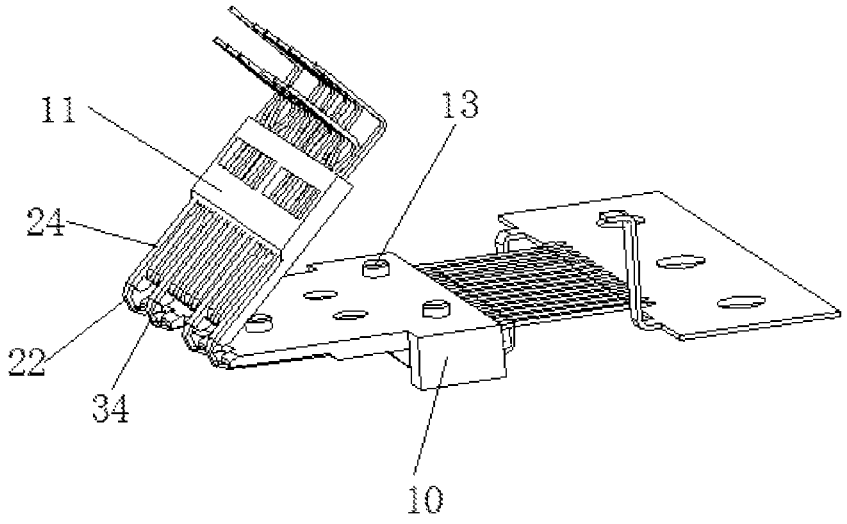
FIG. 4 is a stereogram after a first body and a second body are formed onto the grounding terminals, the power terminals and the signal terminals of the electrical connector of the present invention and the grounding terminals and the power terminals are bent.
Figure 5:
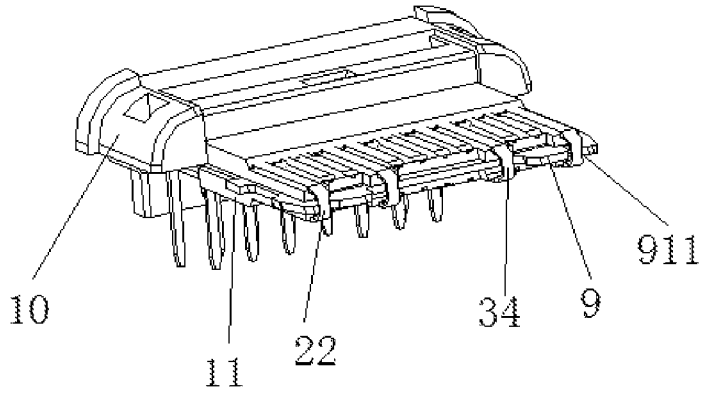
FIG. 5 is an assembly drawing of an insulation body and the grounding terminals, the power terminals, the signal terminals and the shielding plate of the electrical connector of the present invention.
Figure 6:
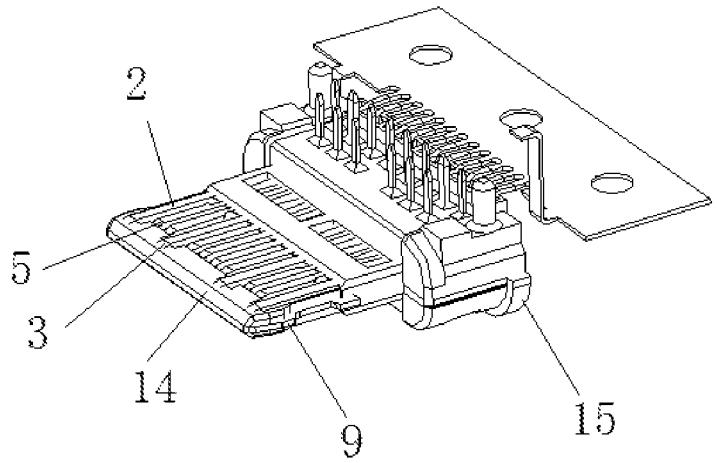
FIG. 6 is a stereogram where there is no shell assembled to the electrical connector of the present invention.
Figure 7:
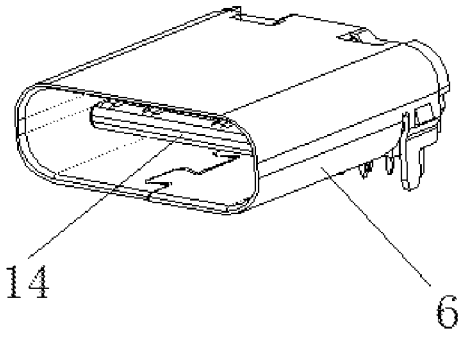
FIG. 7 is an assembly drawing of the electrical connector of the present invention.

Emphatically referring to FIG. 3 to FIG. 4, each grounding terminal 2 is formed by bending a linear wire and comprises an upper contacting portion 21, an upper holding portion 26 and a bending portion 22 extending from two opposite ends of the upper contacting portion 21, an upper welding leg 23 extending from the upper holding portion 26, a lower contacting portion 24 extending from the bending portion 22, a lower holding portion 27 extending from the lower contacting portion 24, and a lower welding leg 25 extending from the lower holding portion 27, wherein the upper contacting portion 21 is parallel to the lower contacting portion 24. Before each grounding terminal 2 is formed, the upper contacting portion 21, the upper holding portion 26, the bending portion 22, the lower holding portion 27 and the lower contacting portion 24 of the grounding terminal 2 are located in the same plane. The thickness of the bending portion 22 is less than that of the upper contacting portion 21 and that of the lower contacting portion 24, and the width of the bending portion 22 is less than that of the upper contacting portion 21 and that of the lower contacting portion 24, such that the bending process of the bending portion 22 is easier.

Each power terminal 3 is formed by bending a linear wire material and comprises a first contacting portion 31, a first holding portion 32 and a second bending portion 34 extending from two opposite ends of the first contacting portion 31, a first welding leg 33 extending from the first holding portion 32, a second contacting portion 35 extending from the second bending portion 34, a second holding portion 37 extending from the second contacting portion 35, and a second welding leg 36 extending from the second holding portion 37. Before each power terminal 3 is formed, the first contacting portion 31, the first holding portion 32, the second bending portion 34, the second holding portion 37 and the second contacting portion 35 of the power terminal 3 are located in a same plane. The thickness of the bending portion 34 is less than that of the first contacting portion 31 and that of the second contacting portion 35, and the width of the bending portion 34 is less than that of the first contacting portion 31 and that of the second contacting portion 35, such that the bending process of the second bending portion 34 is easier.

Each upper-row signal terminal 4 comprises an upper contacting end 41, an upper fixed portion 43 extending from the upper contacting end 41 and an upper welding portion 42 extending from the upper fixed portion 43. Each lower-row signal terminal 5 comprises a lower contacting end 51, a lower fixed portion 53 extending from the lower contacting end 51 and a lower welding portion 52 extending from the lower fixed portion 53. The shielding plate 9 comprises a main plate 91 and a welding leg 92 extending from the main plate 91. The main plate 91 comprises a plurality of positioning holes 910 and groove portions 911. The insulation body 1 comprises positioning pillars 13 fixed with the positioning holes 910. Each groove portion 911 comprises a front groove portion 9110 and a rear groove portion 9111, wherein the width of the front groove portion 9110 is less than that of the rear groove portion 9111, so as to effectively ensure the contact between the bending portions 22 of the grounding terminals 2 and the shielding plate 9. The electrical connector of the present invention further comprises an insulation portion 6 which is insert-molded onto the bending portions 22 of the grounding terminals 2 and the shielding plate 9, and an insulation block 7 which is insert-molded onto the grounding terminals 2, the conducting terminals and the insulation body 1 with an insert-molded method.

Emphatically referring to FIG. 3 to FIG. 4, the insulation body 1 comprises a first body 10 and a second body 12. The first body 10 is insert-molded onto the upper holding portions 26 of the grounding terminals 2, the first holding portions 32 of the power terminals 3 and the upper fixed portions 43 of the upper-row signal terminals 4, and the upper contacting portions 21 of the grounding terminals 2, the first contacting portions 31 of the power terminals 3 and the upper contacting ends 41 of the upper-row signal terminals 4 are exposed on the surface of the first body 10. The second body 12 is insert-molded onto the lower holding portions 27 of the grounding terminals 2, the second holding portions 37 of the power terminals 3 and the lower fixed portions 53 of the lower-row signal terminals 5, and the lower contacting portions 24 of the grounding terminals 2, the second contacting portions 35 of the power terminals 3 and the lower contacting end 51 of the lower-row signal terminals 5 are exposed on the surface of the first body 10.

After the electrical connector of the present invention is assembled, the shielding plate 9 is located between the upper contacting portions 21 and the lower contacting portions 24 of the grounding terminals 2, between the first contacting portions 31 and the second contacting portions 35 of the power terminals 3, and between the upper contacting ends 41 of the upper-row signal terminals 4 and the lower contacting ends 51 of the lower-row signal terminals 5. The bending portions 22 of the grounding terminals 2 are located in the groove portions 911 of the shielding plate 9 and are in contact with the shielding plate 9, such that the crosstalk between the upper-row signal terminals 4 and the lower-row signal terminals 5 is reduced, and the shielding effect is enhanced.

Each grounding terminal 2 of the electrical connector of the present invention is formed by bending a linear wire, and comprises an upper contacting portion 21, a bending portion 22 extending from the upper contacting portion 21, and a lower contacting portion 24 extending from the bending portion 22. The shielding plate 9 is located between the upper contacting portions 21 and the lower contacting portions 24 of the grounding terminals 2. The bending portions 22 of the grounding terminals 2 are in contact with the shielding plate 9, such that the crosstalk between the upper-row signal terminals 4 and the lower-row signal terminals 5 is reduced, and the shielding effect is enhanced. In addition, each power terminal 3 is formed by bending a linear wire, and comprises a first contacting portion 31, a second bending portion 34 extending from the first contacting portion 31, and a second contacting portion 35 extending from the bending portion 34. The shielding plate 9 is located between the first contacting portions 31 and the second contacting portions 35 of the power terminals 3, such that the crosstalk between the upper-row signal terminals 4 and the lower-row signal terminals 5 is reduced, and the shielding effect is enhanced; and meanwhile, each grounding terminal 2 is formed by bending a linear wire, such that the waste materials is reduced, only once electroplating is needed, the manufacturing cost of the grounding terminals 2 is reduced, the assembly is simple and convenient, and the manufacturing cost is reduced.

It should be noted that the above content is merely the optimal implementations of the present invention, rather than all the implementations. Any equivalent variations made by those common skilled in the art by reading the description of the present invention and the technical solution of the present invention should be covered by the claims of the present invention.

What is claimed is:

1. An electrical connector, comprising:

an insulation body, a shielding plate, a plurality of grounding terminals and conducting terminals accommodated in the insulation body;

wherein each grounding terminal is formed by bending a linear wire, and comprises an upper contacting portion, a bending portion extending from the upper contacting portion, and a lower contacting portion extending from the bending portion;

wherein the upper contacting portion is parallel to the lower contacting portion, and the shielding plate is located between the upper contacting portion and the lower contacting portion of the grounding terminal and is in contact with the bending portion;

wherein the shielding plate comprises groove portions, and the bending portions of the grounding terminals are accommodated in the groove portions and are in contact with the shielding plate.

2. An electrical connector according to claim 1, wherein before each grounding terminal is formed, the upper contacting portion, the bending portion and the lower contacting portion of the grounding terminal are located in a same plane.

3. An electrical connector according to claim 1, wherein the thickness of the bending portion is less than that of the upper contacting portion and that of the lower contacting portion, and the width of the bending portion is less than that of the upper contacting portion and that of the lower contacting portion.

4. An electrical connector according to claim 1, wherein each groove portion comprises a front groove portion and a rear groove portion, and the width of the front groove portion is larger than that of the rear groove portion.

5. An electrical connector according to claim 1, wherein the conducting terminals include power terminals, upper-row signal terminals and lower-row signal terminals; the insulation body comprises a first body and a second body; each grounding terminal comprises an upper holding portion extending from the upper contacting portion and a lower holding portion extending from the lower contacting portion; the first body is insert-molded onto the upper holding portions of the grounding terminals, the power terminals and the upper-row signal terminals; and the second body is insert-molded onto the lower holding portions of the grounding terminals, the power terminals and the lower-row signal terminals.

6. An electrical connector according to claim 5, wherein the electrical connector further comprises an insulation portion which is insert-molded onto the bending portions of the grounding terminals and the shielding plate.

7. An electrical connector according to claim 5, wherein each grounding terminal comprises an upper welding leg extending from the upper holding portion and a lower welding leg extending from the lower holding portion; and the electrical connector further comprises an insulation block which is insert-molded onto the upper welding legs and the lower welding legs of the grounding terminals and the shielding plate.

8. An electrical connector according to claim 1, wherein the conducting terminals include power terminals; and each power terminal is formed by bending a linear wire and comprises a first contacting portion, a second bending portion extending from the first contacting portion and a second contacting portion extending from the second bending portion, wherein the first contacting portion is parallel to the second contacting portion, and a shielding plate is located between the upper contacting portion and the lower contacting portion of the power terminal.

9. An electrical connector according to claim 8, wherein, before each power terminal is formed, the first contacting portion, the second bending portion and the second contacting portion of the power terminal are located in a same plane.

10. An electrical connector according to claim 8, wherein the thickness of the bending portion is less than that of the first contacting portion and that of the second contacting portion, and the width of the bending portion is less than that of the first contacting portion and that of the second contacting portion.

11. An electrical connector according to claim 8, wherein the conducting terminals further include upper-row signal terminals and lower-row signal terminals; the insulation body comprises a first body and a second body; each power terminal comprises a first holding portion extending from the first contacting portion and a second holding portion extending from the second contacting portion; the first body is insert-molded onto the first holding portions of the power terminals, the grounding terminals and the upper-row signal terminals; and the second body is insert-molded onto the second holding portions of the power terminals, the grounding terminals and the lower-row signal terminals.

12. An electrical connector according to claim 11, wherein the electrical connector further comprises an insulation portion which is insert-molded onto the bending portions of the power terminals and the shielding plate.

13. An electrical connector according to claim 11, wherein each power terminal comprises a first welding leg extending from the first holding portion and a second welding leg extending from the second holding portion; and the electrical connector further comprises an insulation block which is insert-molded onto the first welding legs and the lower welding legs of the power terminals and the shielding plate.

14. An electrical connector, comprising:

an insulation body, a shielding plate, a plurality of grounding terminals, upper-row signal terminals and lower-row signal terminals accommodated in the insulation body;

wherein the insulation body comprises an upper surface and a lower surface which are opposite; the upper-row signal terminals are located on the upper surface, and the lower-row signal terminals are located on the lower surface;

each grounding terminal comprises an upper contacting portion located on the upper surface, a bending portion bending from the upper contacting portion, and a lower contacting portion extending from the bending portion, the lower contacting portion is located on the lower surface and is parallel to the upper contacting portion;

wherein the shielding plate extends into a space formed by the bending portion and is in contact with the bending portion.

15. An electrical connector according to claim 14, wherein each grounding terminal further comprises an upper holding portion extending from the upper contacting portion, an upper welding leg extending from the upper holding portion, a lower holding portion extending from the lower contacting portion and a lower welding leg extending from the lower holding portion.

16. An electrical connector according to claim 15, wherein the insulation body comprises a first body and a second body, wherein the first body is insert-molded onto the upper holding portions of the grounding terminals and the upper-row signal terminals, and the second body is insert-molded onto the lower holding portions and the lower-row signal terminals.

17. An electrical connector according to claim 15, wherein the electrical connector further comprises an insulation block which is insert-molded onto the upper welding legs and the lower welding legs of the grounding terminals and the shielding plate.

18. An electrical connector according to claim 15, wherein the electrical connector further comprises power terminals accommodated in the insulation body, wherein each power terminal comprises a first contacting portion located on the upper surface, a second bending portion bending from the first contacting portion, and a second contacting portion extending from the second bending portion; and the second contacting portion is located on the lower surface and is parallel to the first contacting portion.

* * * * *